US010336066B2

(12) United States Patent
Tatsuda

(10) Patent No.: US 10,336,066 B2
(45) Date of Patent: Jul. 2, 2019

(54) PRINTER AND CONTROL METHOD OF A PRINTER

(71) Applicant: SEIKO EPSON CORPORATION, Tokyo (JP)

(72) Inventor: Tetsuo Tatsuda, Ina (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/974,265

(22) Filed: May 8, 2018

(65) Prior Publication Data

US 2018/0326721 A1 Nov. 15, 2018

(30) Foreign Application Priority Data

May 10, 2017 (JP) ..... 2017-093696

(51) Int. Cl.
*B41J 2/045* (2006.01)
*B41J 2/21* (2006.01)
(Continued)

(52) U.S. Cl.
CPC ..... *B41J 2/04573* (2013.01); *B41J 2/04505* (2013.01); *B41J 2/04551* (2013.01); *B41J 2/04586* (2013.01); *B41J 2/2132* (2013.01); *B41J 2/2135* (2013.01); *B41J 2/51* (2013.01); *B41J 11/0095* (2013.01); *B41J 11/46* (2013.01)

(58) Field of Classification Search
CPC ..... B41J 2/04573; B41J 2/04505; B41J 2/04551; B41J 2/04586; B41J 2/2132; B41J 2/2135; B41J 2/51; B41J 11/0095; B41J 11/46
See application file for complete search history.

(56) References Cited

U.S. PATENT DOCUMENTS 8,169,657 B2 * 5/2012 Wang ..... H04N 1/50 347/115
9,908,323 B2 * 3/2018 Rossell ..... B41J 11/46
(Continued)

FOREIGN PATENT DOCUMENTS

JP 2005-053228 A 3/2005
JP 2007-185870 A 7/2007
(Continued)

OTHER PUBLICATIONS

Extended European Search Report dated Oct. 5, 2018 in related European Appl. 18171617.6 (7 pgs.).

*Primary Examiner* — Thinh H Nguyen
(74) *Attorney, Agent, or Firm* — Foley & Lardner LLP

(57) ABSTRACT

A printer including: a first printhead and a second printhead configured to eject ink to a print medium; a conveyance mechanism configured to convey the print medium; a camera configured to photograph the print medium; a carriage configured to carry and move the first printhead, the second printhead, and the camera; and a processor configured to print a third mark by the first printhead, photograph the third mark by the camera, adjust driving the conveyance mechanism and the carriage based on a result of the photograph, print a first mark and a second mark by the first printhead and the second printhead respectively, photograph the first mark and the second mark by the camera, and based on the result of the photograph, adjust the ink ejection timing of the second printhead.

12 Claims, 4 Drawing Sheets

(51) Int. Cl.

| | |
|---|---|
| ***B41J 11/00*** | (2006.01) |
| ***B41J 11/46*** | (2006.01) |
| ***B41J 2/51*** | (2006.01) |

(56) References Cited

U.S. PATENT DOCUMENTS

| | | | | |
|---|---|---|---|---|
| 2005/0024410 | A1 | 2/2005 | Subirada et al. | |
| 2010/0121477 | A1 | 5/2010 | Jonas et al. | |
| 2011/0273502 | A1* | 11/2011 | Eun | B41J 2/17593 347/14 |
| 2012/0147074 | A1 | 6/2012 | Ikeda et al. | |
| 2014/0259595 | A1 | 9/2014 | Von Essen et al. | |

FOREIGN PATENT DOCUMENTS

| | | | |
|---|---|---|---|
| JP | 2009-066902 | A | 4/2009 |
| JP | 2010-030257 | A | 2/2010 |
| JP | 2018-187873 | A | 11/2018 |
| JP | 2018-187874 | A | 11/2018 |

* cited by examiner

PRINTER AND CONTROL METHOD OF A PRINTER

This application claims priority under 35 U.S.C. § 119 to Japanese Patent Application No. 2017-93696 filed on May 10, 2017, the entire disclosure of which is expressly incorporated by reference herein.

BACKGROUND

1. Technical Field

The present invention relates to a printing device (printer) having a plurality of printheads, and relates more particularly to a printing device capable of device adjustment (calibration).

2. Related Art

Inkjet printers that print on print media by ejecting ink from ink nozzles are common today. Because such printers are susceptible to printing defects such as blotchy colors due to conditions of the printer, detecting such problems and adjusting the printer accordingly is necessary.

In the case of a large format printer, this device calibration task is generally done by a maintenance technician when assembling the printhead or replacing the printhead. This task involves the maintenance technician visually checking the printed output of a test pattern, and based on the results, manually configuring settings related to the printing operation.

JP-A-2005-53228 describes related technology for calibrating a scanner in a configuration having a scanner disposed to a carriage together with the ink cartridges.

However, such conventional manual methods of device calibration are complicated, time consuming, and labor intensive. In addition, wrong position adjustment values may be input mistakenly.

In addition, the technology described in JP-A-2005-53228 is silent about adjusting for printhead installation errors.

SUMMARY

At least one objective of the present invention is to provide a printing device (printer) that has a plurality of printheads and can adjust (calibrate) the printheads.

To achieve the foregoing objective, a printer according to the invention includes: a first printhead and a second printhead configured to eject ink to a print medium; a conveyance mechanism configured to convey the print medium; a camera configured to photograph the print medium; a carriage configured to carry and move the first printhead, the second printhead, and the camera; and a processor configured to print a third mark by the first printhead, photograph the third mark by the camera, adjust deviation of at least driving the conveyance mechanism and the carriage based on a result of the photograph, print a first mark and a second mark by the first printhead and the second printhead respectively, photograph the first mark and the second mark by the camera, and based on the result of the photograph, adjust the ink ejection timing of the second printhead.

This aspect of the invention eliminates the need for manual device adjustment (calibration).

Further preferably in a printer according to another aspect of the invention, adjustment of driving the conveyance mechanism and the carriage by the processor is based on a difference between a position of the photographed third mark and a reference position on the path of movement of the carriage.

This aspect of the invention enables easily adjusting positions in the main scanning direction and sub-scanning direction.

Yet further preferably in a printer according to another aspect of the invention, the first mark is a plurality of first line marks printed by the first printhead ejecting ink at a first timing, and the second mark is a plurality of second line marks printed by the second printhead ejecting ink at a plurality of second timings each different from the first timing at appropriate positions relative to the first line marks; and adjustment of the ink ejection timing of the second printhead by the processor is based on the second timing of the second line marks printed closest to the most desirable position.

In adjustment according to this aspect of the invention, the processor, when the second timing is offset by one dot or more from the first timing, executes an image process that shifts the image data to be printed in dot units, and when the timing is offset by one dot or less, executes a process shifting the output timing of the nozzle drive signal.

This aspect of the invention enables adjusting the second printhead relatively based on the offset from the first printhead.

Another aspect of the invention is a control method of a printer including a first printhead and a second printhead configured to eject ink to a print medium; a conveyance mechanism configured to convey the print medium; a camera configured to photograph the print medium; and a carriage configured to carry and move the first printhead, the second printhead, and the camera. The control method includes steps of: printing a third mark by the first printhead; photographing the third mark by the camera; adjusting deviation of at least driving the conveyance mechanism and the carriage based on a result of the photograph; printing a first mark and a second mark by the first printhead and the second printhead respectively; photographing the first mark and the second mark by the camera; and based on the result of the photograph, adjusting the ink ejection timing of the second printhead.

Other objects and attainments together with a fuller understanding of the invention will become apparent and appreciated by referring to the following description and claims taken in conjunction with the accompanying drawings.

DESCRIPTION OF EMBODIMENTS

Figure 1:
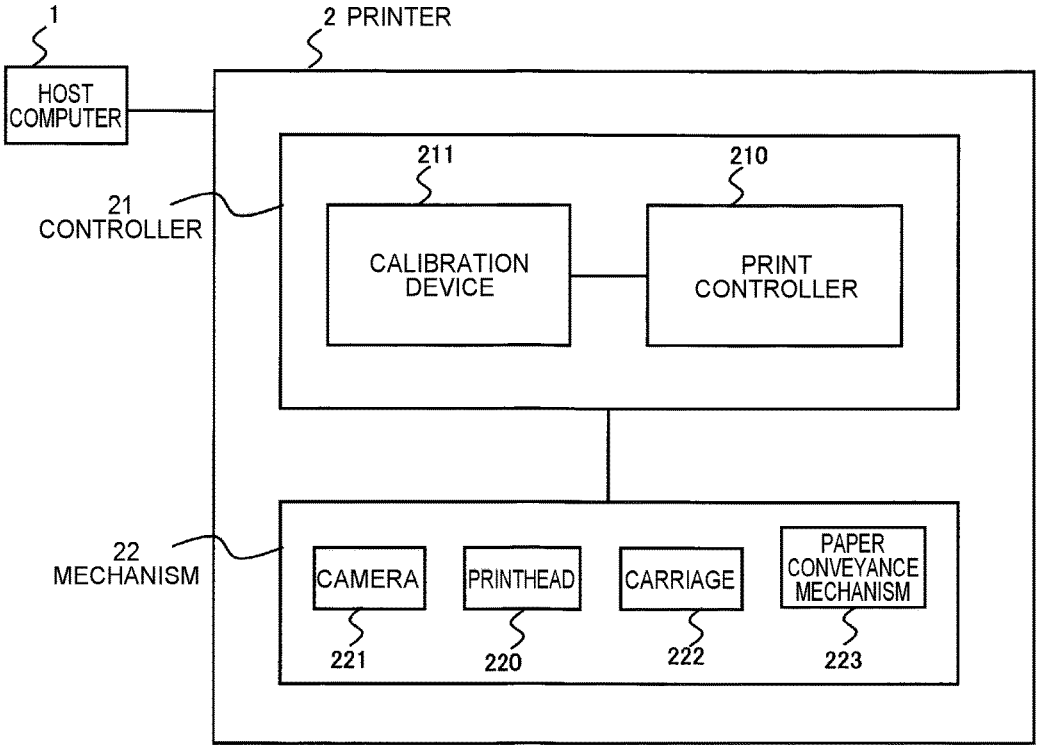
FIG. 1 schematically illustrates the configuration of a printer according to a preferred embodiment of the invention.

An embodiment of the present invention is described below with reference to the accompanying figures. However, the embodiment described below does not limit the technical scope of the invention. Note that in the figures like or similar parts are identified by the same reference numerals or reference symbols.

FIG. 1 schematically illustrates the configuration of a printer according to the invention. The printer 2 shown in FIG. 1 is a printer described as a preferred embodiment of the invention.

This printer 2 has a plurality of printheads 220 and a camera 221 mounted on a carriage 222, and a controller 21 that executes a device adjustment (calibration) process when a printhead 220 is replaced, for example.

In this calibration process, the controller 21 of the printer 2 controls a printhead 220 used as a reference (referred to below as the reference printhead or first printhead) to print a test pattern of positioning marks (third marks), controls the camera 221 to photograph the test pattern, and based on the imaged results, adjust driving the carriage 222 and paper conveyance mechanism 223.

The controller 21 then prints a test pattern of multiple line marks (first marks, second marks) by the reference printhead 220 and other printheads 220 (referred to below as other printheads or second printheads) at offset times, controls the camera 221 to photograph the test pattern, and based on the imaged results, adjusts the ink ejection timing of the other printheads 220.

These processes enable automatically calibrating the printer 2 with good precision.

As shown in FIG. 1, a printer 2 according to this embodiment is a printer that prints on a print medium such as paper M in response to a print request from a host computer 1, for example, and in this embodiment of the invention is a large format inkjet printer used for printing posters, for example.

As shown in FIG. 1, the printer 2 includes a controller 21 and a mechanism 22.

The controller 21 is a controller that controls other parts of the printer 2, and is embodied by memory storing a program describing the content of a process, a CPU (processor) that executes processes according to the program, RAM, memory such as ROM that stores programs, or an ASIC device. The CPU, by reading and running a program stored in ROM, functions as a print controller 210 and calibration device 211.

The printer 2 has a normal mode (printing mode) and an inspection mode.

In the normal mode, when print data is received from the host computer 1, for example, the controller 21 controls the printhead 220, the carriage 222, and the paper conveyance mechanism 223 based on the print data, and executes the requested printing process on the paper M or other print medium. When controlling the printhead 220, the controller 21 causes the printhead 220 to eject (discharge) ink from multiple nozzles of the printhead 220.

In the inspection mode for device adjustment (calibration), the controller 21 controls the mechanism 22 described below to execute processes including printing a test pattern, imaging (photographing) the test pattern, image processing the resulting photograph (image data), analyzing the image data, and an adjustment process based on the results of the analysis.

The controller 21 has a functional configuration such as shown in FIG. 1. The controller 21 includes a print controller 210, and a calibration device 211.

When a print request is sent to the printer 2, the print controller 210 interprets the print data, and based on the result controls parts of the mechanism 22 and executes the printing process on the print medium (such as paper M).

In the inspection mode, the print controller 210 prints test patterns.

The calibration device 211 controls processing in the inspection mode described above. The specific content of this process by the calibration device 211 is described further below.

The mechanism 22 is controlled by the controller 21, and executes the printing process in the normal mode and the inspection mode, and the imaging process in the inspection mode. As shown in FIG. 1, the mechanism 22 includes printheads 220, a camera 221, a carriage 222, and a paper conveyance mechanism 223.

Figure 2:
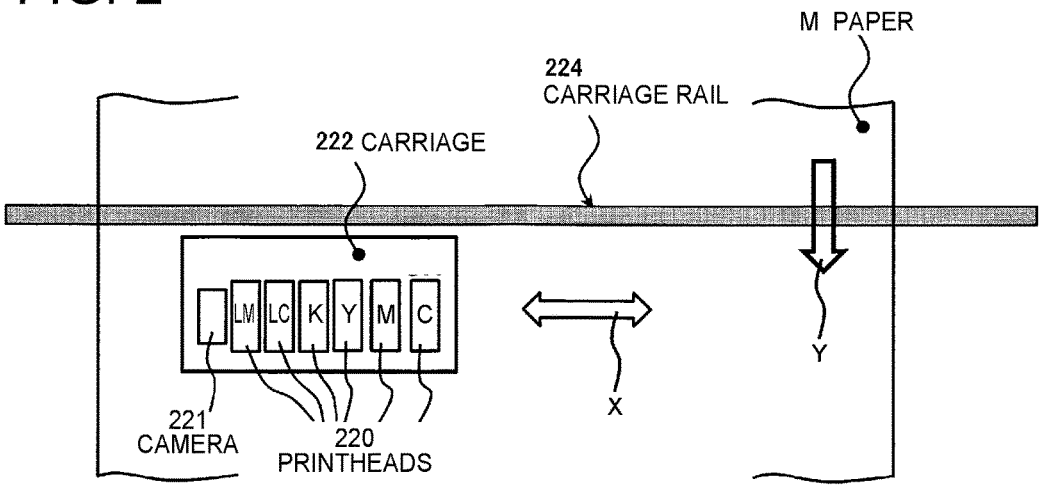
FIG. 2 is a plan view schematically illustrating the mechanism 22 around the carriage 222.

FIG. 2 is a plan view schematically illustrating the mechanism 22 around the carriage 222.

The printheads 220 have a plurality of nozzles, and eject ink from the nozzles to the paper M, forming images on the paper M and printing according to commands from the controller 21 (print controller 210).

As shown in FIG. 2, the printer 2 has a plurality of printheads 220 (in this example, six) mounted on a carriage 222. In this example, the printer 2 uses six different colors of ink (C: cyan, M: magenta, Y: yellow, K: black, LC: light cyan, LM: light magenta). There is a printhead 220 for each of the six different colors of ink, and each printhead 220 is installed to a holder on the carriage 222. The printheads 220 for each color can be separately removed (replaced), and deviation may therefore occur in the installation position of individual printheads 220.

In the inspection mode, the camera 221 (imaging device) takes a picture of the paper M, which is the print medium, and generates image data representing the image (test pattern) printed on the paper M by the printheads 220 for each color of ink. As shown in FIG. 2, the camera 221 is carried on the carriage 222. In one example, the camera 221 includes a CMOS sensor and a lens.

A light source is disposed near the camera 221, and the light source emits light enabling imaging by the camera 221. The light source emits light to the subject of the camera 221 (the imaged area), and light output is adjustable. The light source in this example comprises multiple LED lamps. The installation position of the camera 221 is preferably calibrated to the correct position to enable precise imaging.

The carriage 222 carries the printheads 220 and camera 221, and moves the printheads 220 and camera 221 in the scanning direction (main scanning direction, along the X-axis indicated by the arrows in FIG. 2). The carriage 222 drives along the carriage rail 224 by means of a motor or other drive source, and gears, a belt, or other power transfer mechanism. The carriage 222 moves as controlled by the print controller 210 when printing, for example.

As shown in FIG. 2, when printing, ink of the colors corresponding to the printheads 220 is ejected from the printhead 220 moving by means of the carriage 222 in the main scanning direction onto the paper M being conveyed in the sub-scanning direction (in the direction of arrow Y in FIG. 2), and an image is formed on the paper M.

The paper conveyance mechanism 223 (conveyance mechanism) is a device that conveys the paper M in the sub-scanning direction, and includes conveyance rollers, a drive source for the rollers, a power transfer mechanism, and a conveyance path. The paper conveyance mechanism 223 is driven as controlled by the print controller 210 when printing, for example.

In the printer 2 configured as described above according to this embodiment, the controller 21 selects and operates in a normal mode or an inspection mode. In the normal mode, the printer 2 receives print requests (print data) from the host computer 1, and in response, the controller 21 (print controller 210) controls parts of the mechanism 22 to print on the paper M, which is the print medium. More specifically, the printhead 220 moves in the main scanning direction and ejects ink onto the paper M conveyed in the sub-scanning direction to form images. After printing, the paper M is discharged by the paper conveyance mechanism 223.

As described above, in the inspection mode, a device adjustment (calibration) process of the printer 2 is executed by changing to calibration device 211 control. This process is described more specifically below.

Figure 3:
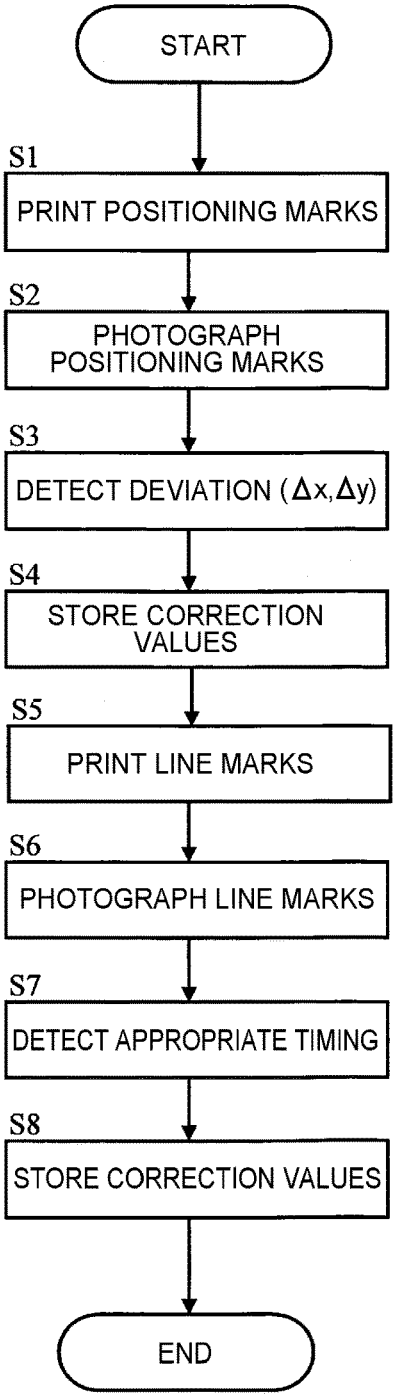
FIG. 3 is a flow chart showing steps in the process executed in the calibration process.

FIG. 3 is a flow chart of steps in the calibration process. The printer 2 according to this embodiment executes the calibration process when a printhead 220 is replaced, for example, to adjust for printing problems resulting from the printheads 220 (more specifically, the installation position of a printhead 220). This example describes calibrating all (six) of the printheads 220, but it will also be obvious that calibration may be limited to one or more specific printheads 220, such as only a printhead 220 that is replaced.

This calibration process first selects a reference printhead 220 (in this example, the black (K) printhead 220), applies the adjustment process to the reference printhead 220, and then adjusts the other printheads 220 based on the relative deviation from the reference printhead 220.

When the inspection mode is selected by the operator using a button, keyboard, mouse, or other input means of the printer 2 or host computer 1, and the calibration device 211 is activated, the calibration device 211 first uses the reference printhead 220 to start adjusting for deviation (error) in the main scanning direction and sub-scanning direction alignment of the complete printhead 220.

Figure 4:
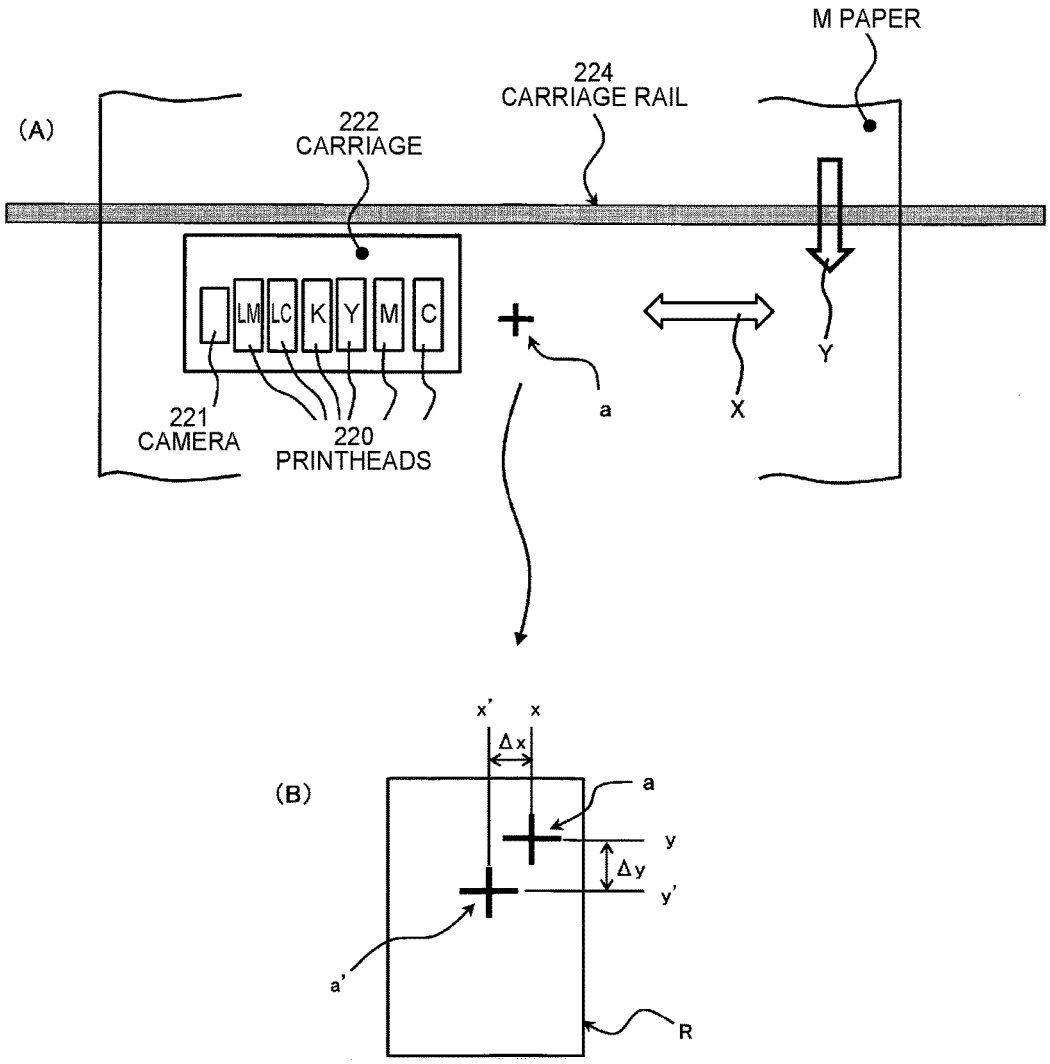
FIG. 4 illustrates a positioning mark a and adjustment based thereon.

First, the calibration device 211 drives the carriage 222 to print positioning marks on the paper M by the reference printhead 220 (step S1 in FIG. 3). FIG. 4 illustrates a positioning mark a and adjustment based thereon. The cross-shaped mark shown in FIG. 4 is the positioning mark a in this example. The positioning mark a is printed as a test pattern at a position such as shown in FIG. 4 (A) by the K (black ink) printhead 220 (reference printhead).

Next, the calibration device 211 drives the carriage 222 to move the camera 221, and by the camera 221 photographs the positioning mark a that was printed (step S2 in FIG. 3). The image data for the imaging area R generated by the photograph (camera 221) is then sent from the camera 221 to the calibration device 211.

The calibration device 211 then analyzes the received image data, and detects deviation in the main scanning direction ($\Delta x$) and deviation in the sub-scanning direction ($\Delta y$) at the printing position of the reference printhead 220 (step S3 in FIG. 3). More specifically, the calibration device 211 first detects the positioning coordinates (x, y) of the center of the positioning mark a in the received image data. The positioning coordinates (x, y), as shown in FIG. 4 (B), define the distance in the main scanning direction and sub-scanning direction from a specific corner of a rectangular imaging area R.

Next, the calibration device 211 calculates the difference between the actual positioning coordinates (x, y) that were detected, and the coordinates (x', y') of the center point of a positioning mark a' located at an ideal (correct) position (reference position) that is predefined and is previously stored in memory. More specifically, the calibration device 211 calculates $\Delta x = x' - x$, $\Delta y = y' - y$ to determine deviation $\Delta x$ and deviation $\Delta y$.

Next, the calibration device 211 stores the calculated deviation $\Delta x$ as the correction value for movement of the carriage 222 when printing, and the calculated deviation $\Delta y$ as the correction value for conveyance of the paper M by the paper conveyance mechanism 223 when printing, in non-volatile memory of the controller 21 (step S4 in FIG. 3).

Note that these correction values may be stored in memory after converting deviation $\Delta x$ and deviation $\Delta y$ to the parameter values used for control of the carriage 222 and paper conveyance mechanism 223. In addition, storing the correction values may be a process of changing settings referenced by the print controller 210 when printing. Furthermore, if deviation $\Delta x$ or deviation $\Delta y$ is not detected, correction of the deviation $\Delta x$ or deviation $\Delta y$ that was not detected is not necessary.

Next, the calibration device 211 starts the process of adjusting the other printheads 220.

First, the calibration device 211 drives the carriage 222 to start using all printheads 220 to print a test pattern of multiple line marks for each printhead 220 (step S5 in FIG. 3).

Figure 5:
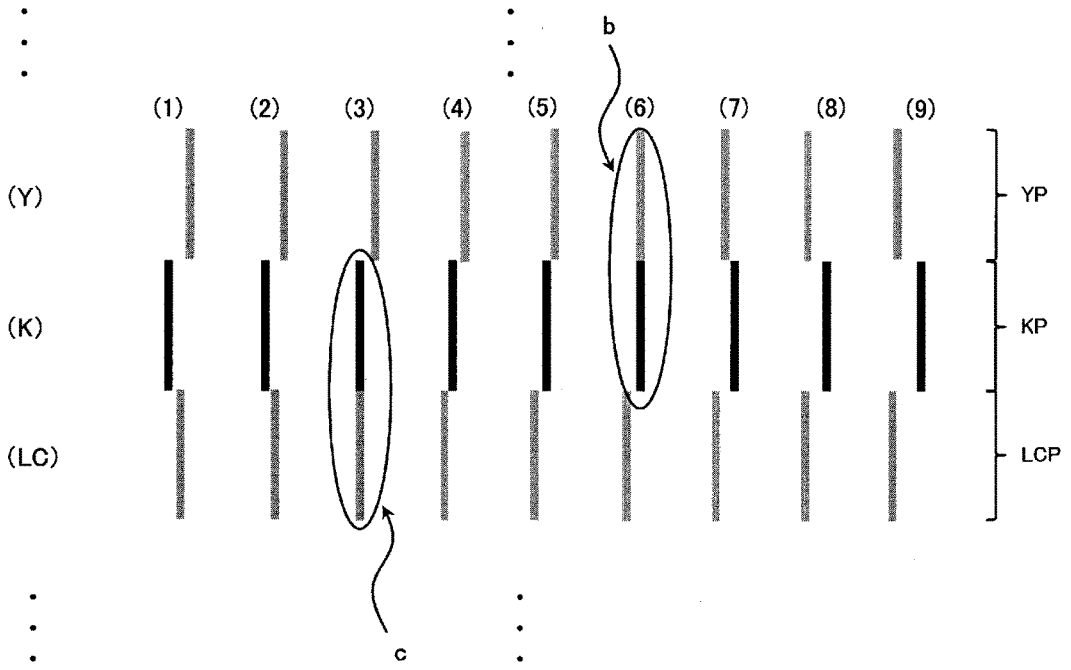
FIG. 5 illustrates line marks and adjustment based thereon.

FIG. 5 illustrates the line marks and the adjustment process using the line marks.

Line (K) in FIG. 5 shows examples of nine line marks (first marks) printed at KP (printing position P of printhead K) (1) to KP (9)) by the black (K) printhead 220 of the printhead 220. These line marks printed by the reference printhead 220 are printed at the ink ejection timing (first timing) set by the print controller 210 at that time.

Lines (Y) and (LC) in FIG. 5 show examples of nine line marks (second marks) by the yellow other printhead (Y) 220 and light cyan (LC) other printhead 220 of the printhead 220 at YP (1) to YP (9) and LCP (1) to LCP (9) (printing positions P (1) to P (9) of printhead Y, and printing positions P (1) to P (9) of printhead LC).

The line marks printed by the other printheads 220 are printed to be at the same position in the main scanning direction (left-right in FIG. 5) as the line marks printed by the printhead 220. More specifically, line mark YP (1) and line mark LCP (1) are printed to be at the same position in the main scanning direction as line mark KP (1). The other line marks (1) to (9) are printed in the same way.

The line marks printed by the other printheads printhead 220, unlike the line marks printed by the reference printhead 220, are printed at an ink ejection time offset a specific time for each line. More specifically, line mark YP (5) and line mark LCP (5) are printed at the ink ejection timing (referred to below as the reference timing) set by the print controller 210 at that time in the same way as the reference printhead 220.

However, line marks YP (1)-(4) and line marks LCP (1)-(4) are printed at a timing delayed from the reference timing, with the difference to the reference timing increasing with distance from line mark (5). Similarly, line marks YP (6)-(9) and line marks LCP (6)-(9) are printed at a timing before the reference timing, with the difference to the reference timing increasing with distance from line mark (5).

In addition, the line marks printed by the printheads 220 for the other colors are printed by a subset of the nozzles of each printhead 220 so as to not overlap in the sub-scanning direction (vertically in FIG. 5).

Note that similar line marks (not shown in FIG. 5) are printed by the remaining printheads 220 of the other printheads 220.

Next, the calibration device 211 drives the carriage 222 to photograph the printed line marks with the camera 221 (step S6 in FIG. 3). Image data generated for the photographed line marks is sent from the camera 221 to the calibration device 211.

The calibration device 211 analyzes the received image data, and detects the appropriate ejection timing of the other printheads 220 (step S7 in FIG. 3). More specifically, the calibration device 211 compares, for each other printhead 220, the position in the main scanning direction of each line mark ((1) to (9) in FIG. 5), and the position in the main scanning direction of the corresponding line mark printed by the reference printhead 220 (in this example, printhead 220 (K)), and selects the line mark most nearly matching (close to) the position of the line mark printed by the reference printhead 220. The calibration device 211 then detects the ink ejection timing when the selected line mark was printed as the ink ejection timing appropriate for the other printheads 220. In other words, sets the time of the ink ejection timing offset when the selected line mark was printed as the correction value.

In the case of other printhead 220 (Y) in the example shown in FIG. 5, line mark YP (6) at (b) in FIG. 5 is closest to (matches) the position in the main scanning direction of the line mark printed by the reference printhead 220 (K). As a result, the ink ejection timing when line mark YP (6) was printed is detected as the appropriate ink ejection timing.

In addition, in the case of other printhead 220 (LC) in the example shown in FIG. 5, line mark LCP (3) at (c) in FIG. 5 is closest to (matches) the position in the main scanning direction of the line mark printed by the reference printhead 220 (K). As a result, the ink ejection timing when line mark LCP (3) was printed is detected as the appropriate ink ejection timing.

Once the appropriate ink ejection timing for the other printheads 220 is detected, the calibration device 211 stores the corresponding ink ejection timings as the correction value in the nonvolatile memory of the controller 21 (step S8 in FIG. 3). In other words, the line marks printed by the other printheads 220 that are closest to the line marks printed by the reference printhead 220 are selected, and the correction values based on the time of the ink ejection timing offset when the line marks were printed are acquired and stored in memory.

Note that these correction values may be stored after being converted to the parameter value used for controlling image processing of the print data and the output timing of the ink drive signal.

In addition, storing the correction values may be a process of changing settings referenced by the print controller 210 when printing.

The device calibration process of the calibration device 211 is executed as described above.

When printing, high quality printing is achieved by the print controller 210 reading the corrective values stored in memory to appropriately printing. More specifically, the print controller 210, based on the correction values in memory, corrects while controlling movement of the carriage 222, the conveyance distance of the paper M by the paper conveyance mechanism 223, and the ink ejection timing of the printheads 220. For example the print controller 210, when controlling the ink ejection timing, executes imaging processing to shift the image data in dot units when the appropriate ink ejection timing is offset one dot or more from the reference timing, and executes a process offsetting the output timing of the nozzle drive signal when the ink ejection timing is offset one dot or less.

As described above, a printer 2 according to this embodiment of the invention has a camera 221 mounted on a carriage 222, and based on an image of a test pattern photographed by the camera 221, applies device adjustment (calibration) when a printhead 220 mounted on the carriage 222 is replaced, for example.

In this calibration process, the reference printhead 220 is first adjusted in the main scanning direction and the sub-scanning direction based on positioning marks printed by the selected reference printhead 220. Next, the ink ejection timing of the printheads 220 is adjusted based on the deviation of the ink ejection timing when the difference of the position of the line marks printed while offsetting the ink ejection timing of the other printheads to the line marks printed by the reference printhead 220 is smallest.

Device adjustment of the printer 2 is therefore completed without error or intervention by a maintenance technician, reducing the time and effort required by a maintenance technician. In addition, calibration can be completed efficiently and with great precision by adjustment based on the reference printhead 220 and adjustment based on deviation relative to the reference printhead 220.

Furthermore, calibration can be completed relatively easily based on positioning marks printed by the reference printhead 220 and line marks printed by other printheads 220 referenced to the reference printhead 220.

Furthermore, the functional parts shown for example in FIG. 1 illustrate the functional configuration of the invention, but actual embodiments are not limited thereto. More specifically, hardware components corresponding individually to each function unit are not necessarily required, and configurations in which a single processor embodies the functions of multiple function units by executing a specific program or programs are obviously conceivable. Some functions embodied by software in the foregoing embodiments may instead be embodied by hardware, and some functions embodied by hardware in the foregoing embodiments may instead be embodied by software. In addition, the detailed configuration of parts of the printer 2 can be varied in many ways without departing from the scope and intent of the invention.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A printer comprising:

a first printhead and a second printhead configured to eject ink to a print medium;

a conveyance mechanism configured to convey the print medium;

a camera configured to image the print medium;

a carriage configured to carry and move the first printhead, the second printhead, and the camera; and a processor configured to cause the first printhead to print a third mark, cause the camera to image the third mark by the camera, adjust deviation of at least driving the conveyance mechanism and the carriage based on a result of imaging the third mark, cause the first printhead and the second printhead to print a first mark and a second mark, respectively, cause the camera to image the first mark and the second mark, and based on a result of imaging the first and second marks, adjust the ink ejection timing of the second printhead, wherein the first printhead, the second printhead, and the camera are mounted on the carriage.

2. The printer described in claim 1, wherein:

the processor is further configured to perform adjustment of driving the conveyance mechanism and the carriage based on a difference between a position of the imaged third mark and a reference position on the path of movement of the carriage.

3. The printer described in claim 1, wherein:

the first mark is a plurality of first line marks printed by the first printhead ejecting ink at a first timing, and the second mark is a plurality of second line marks printed by the second printhead ejecting ink at a plurality of second timings each different from the first timing at appropriate positions relative to the first line marks; and the processor is further configured to perform adjustment of the ink ejection timing of the second printhead based on the second timing of the second line marks printed closest to one of the plurality of first line marks.

4. The printer described in claim 3, wherein:

in performing adjustment of the ink ejection timing of the second printhead, the processor is further configured to execute an image processing operation that shifts image data to be printed by dot units when the second timing is offset by one dot or more from the first timing.

5. The printer described in claim 3, wherein:

in performing adjustment of the ink ejection timing of the second printhead, the processor is further configured to execute an image processing operation that shifts an output timing of a nozzle drive signal when the second timing is offset by one dot or less from the first timing.

6. The printer described in claim 1, wherein:

the first printhead and the second printhead eject different colors of ink.

7. A control method of a printer including a first printhead and a second printhead configured to eject ink to a print medium;

a conveyance mechanism configured to convey the print medium;

a camera configured to image the print medium; and a carriage configured to carry and move the first printhead, the second printhead, and the camera, the control method comprising:

causing the first printhead to print a third mark;

causing the camera to image the third mark;

adjusting deviation of at least driving the conveyance mechanism and the carriage based on a result of imaging the third mark;

causing the first printhead and the second printhead to print a first mark and a second mark, respectively;

causing the camera to image the first mark and the second mark; and based on the result of imaging the first and second marks, adjusting the ink ejection timing of the second printhead, wherein the first printhead, the second printhead, and the camera are mounted on the carriage.

8. The control method of a printer described in claim 7, wherein:

adjustment of driving the conveyance mechanism and the carriage includes performing the adjustment based on a difference between a position of the imaged third mark and a reference position on the path of movement of the carriage.

9. The control method of a printer described in claim 7, wherein:

the first mark is a plurality of first line marks printed by the first printhead ejecting ink at a first timing, and the second mark is a plurality of second line marks printed by the second printhead ejecting ink at a plurality of second timings each different from the first timing at appropriate positions relative to the first line marks; and adjustment of the ink ejection timing of the second printhead includes performing the adjustment based on the second timing of the second line marks printed closest to one of the plurality of first line marks.

10. The control method of a printer described in claim 9, wherein:

adjustment of the ink ejection timing of the second printhead includes executing an image processing operation that shifts image data to be printed by dot units when the second timing is offset by one dot or more from the first timing.

11. The control method of a printer described in claim 9, wherein:

adjustment of the ink ejection timing of the second printhead includes executing an image processing operation that shifts an output timing of a nozzle drive signal when the second timing is offset by one dot or less from the first timing.

12. The control method of a printer described in claim 7, wherein:

the first printhead and the second printhead eject different colors of ink.

* * * * *